US006854129B2

(12) United States Patent
Mazzarolo

(10) Patent No.: US 6,854,129 B2
(45) Date of Patent: Feb. 15, 2005

(54) KNEE-PAD APPLICABLE TO A SPORTS GARMENT

(75) Inventor: Gabriele Mazzarolo, Coste Di Maser (IT)

(73) Assignee: Alpinestars Research SRL, Treviso (IT)

( * ) Notice: Subject to any disclaimer, the term of this patent is extended or adjusted under 35 U.S.C. 154(b) by 0 days.

(21) Appl. No.: 10/813,751

(22) Filed: Mar. 26, 2004

(65) Prior Publication Data

US 2004/0181842 A1 Sep. 23, 2004

Related U.S. Application Data

(63) Continuation of application No. PCT/EP02/09829, filed on Sep. 3, 2002.

(30) Foreign Application Priority Data

Oct. 2, 2001 (IT) ..... 2001U000051

(51) Int. Cl.[7] ..... A41D 13/00

(52) U.S. Cl. ..... 2/23

(58) Field of Search ..... 2/23, 24, 16, 267, 2/455, 69, 79, 227, 911; 602/23, 26, 62

(56) References Cited

U.S. PATENT DOCUMENTS 3,484,868 A * 12/1969 Davenport, Jr. ..... 2/465
5,732,412 A * 3/1998 Holden ..... 2/23
5,794,275 A * 8/1998 Donzis ..... 2/455
6,219,845 B1 * 4/2001 Ferriter ..... 2/24
6,669,355 B2 * 12/2003 Layne et al. ..... 362/294

* cited by examiner

*Primary Examiner*—Tejash Patel
(74) *Attorney, Agent, or Firm*—Katten Muchin Zavis Rosenman

(57) ABSTRACT

Knee-pad comprising a first part (10) able to fastened onto a sports garment and a second part (30) able to withstand abrasion. Interfacing means (24*a* . . . 24*d*, 14*a* . . . 14*d*), preferably of the bayonet type, allow the said second part (30) to be separated from the first part (10) without the latter being removed from the garment.

6 Claims, 2 Drawing Sheets

KNEE-PAD APPLICABLE TO A SPORTS GARMENT

The present application is a continuation of and claims priority under 35 USC §120 from International PCT Application No. PCT/EP02/09829 filed on Sep. 3, 2002 and claims priority under 35 USC §119 from Italian Patent Application No. TV2001U000051 filed on Oct. 2, 2001.

The present invention relates to a knee-pad which can be applied to a sports garment.

It is known that, in several sports activities, it is required to ensure special protection of parts of the body which risk injury—sometimes of a particular serious nature, as in the case of accidents involving falls or, in any case, violent impact with the ground. Of the parts of the body which need to be protected, the knees are of particular importance for persons practising sports such as motorcycling racing, skating, hockey and downhill skiing; as a result, their garment (trousers, either separate or forming part of a suit) are provided with—or at least have attached to them—knee-pads. The knee-pads moreover are also required not to impede the freedom of movement of the legs required for normal practise of the sports activity and, as far as possible, must prevent injury such as torn muscles or tearing of the parts of the garment on which are they are provided or attached, since the materials from which the latter are usually made have a limited abrasion resistance.

In the specific case of sports activities involving the use of motorcycles at high speeds, the knee-pads used by the riders must also perform another function, namely must allow frictional contact between the surface of the ground and the outer part of the knees on the inside of bends whenever the motorcycle assumes a rolled-over condition, i.e. in the bends of the race circuit.

A specific knee-pad for this type of competition—disclosed in the patent application EP-A-0 455 348—comprises a plurality of elements in the form of a circle segment and a sheet of flexible material. The segments are connected together at the base so as to form an abrasive-resistant disk and are manufactured using a material such as polypropylene which allows the knee-pad to assume a shape matching the rider's knee. The said disk is sewn onto the first side of the sheet of flexible material, which is a disk with a larger diameter, on the second side of which a layer of Velcro® is provided for atachment onto the trousers. As a segment becomes worn owing to frictional contact with the ground, the Velcro® allows the knee-pad to be temporarily detached, rotated about the common centre of the circle segments and fixed again onto the trousers in a different angular arrangement so as to have on the outer side of the knee at least one circle segment which is not yet worn.

A knee-pad of this kind, owing to the fact that it is made exclusively of deformable or flexible materials, while it is effective for preventing or limiting damage due to abrasion, does not offer adequate guarantees in the cases where—for example when entering a bend—lowering of the motorcycle into the rolled-over position results in a violent impact of the knee with the ground. Moreover, in the case of particularly severe stressing, the entire knee-pad must be discarded.

Other knee-pads known in the art are discussed herebelow.

DE-U-200 17 594 discloses a pad for protecting against impacts a knee or an elbow of an user consisting in a first part able to be fastened onto a sports garment and a second part which are connected to one another by cushioning means. The cushioning means is firmly secured to the said first part and joined to the said second part with the possibility of moving in case of an impact occurring at the same second part. It is not foreseen to replace either the whole pade or at least the said second part for the apparent reason that the pad is intended only intended for uses where the impacts are a mere and remote event while it is not foreseen that the pad has repeated frictional contacts with the surface of a road or a race circuit.

GB-A-2 356 127 discloses a localised protection guard for motorcyclists comprising a first part able to be attached to a garment and a second outer part where a protruding seat is provided for the accomodation of an element of abrasion resistant material having a tip protruding from the said tip. No details are disclosed how to replace a worn element, even if such replacement is foreseen.

WO-A-02/21950 (published after the priority date of the present patent application) discloses a slider, namely a knee-pad for racing motorcyclists, comprising a first part or base fixed to the garment and a second abrasion-resistant part or protection body constrained to the said base by means of a coupling sliding in the base plate (bayonet coupling), namely in a direction substantially parallel to the surface of the garment whereon the pad is fixed. To permit replacement, it suffices to manually provoke a localised deformation of the base and subsequently to introduce the blade of a screwdriver to further deform the base and allow sliding and extraction of the protection body. It is worth noting that this slider has a low resistance to impacts in consideration that the base is made of a deformable plastic material and the protection body is also made of a plastic material. Moreover the replacement needs the use of a tool such as the mentioned screwdriver.

The object of the present invention is accordingly to provide a knee-pad which ensures a better protection of the user, in particular the rider of a motorcycle, in the event of accidents involving an impact with the ground, and which comprises separate parts optimised to respectively withstand impacts and resist abrasion.

This and other objects are achieved with a knee-pad having the characteristic features of the appended claims.

In order to better clarify these characteristic features and the consequent advantages, a preferred but not exclusive embodiment of the invention will now be described with reference to the accompanying drawing in which.

Figure 1:
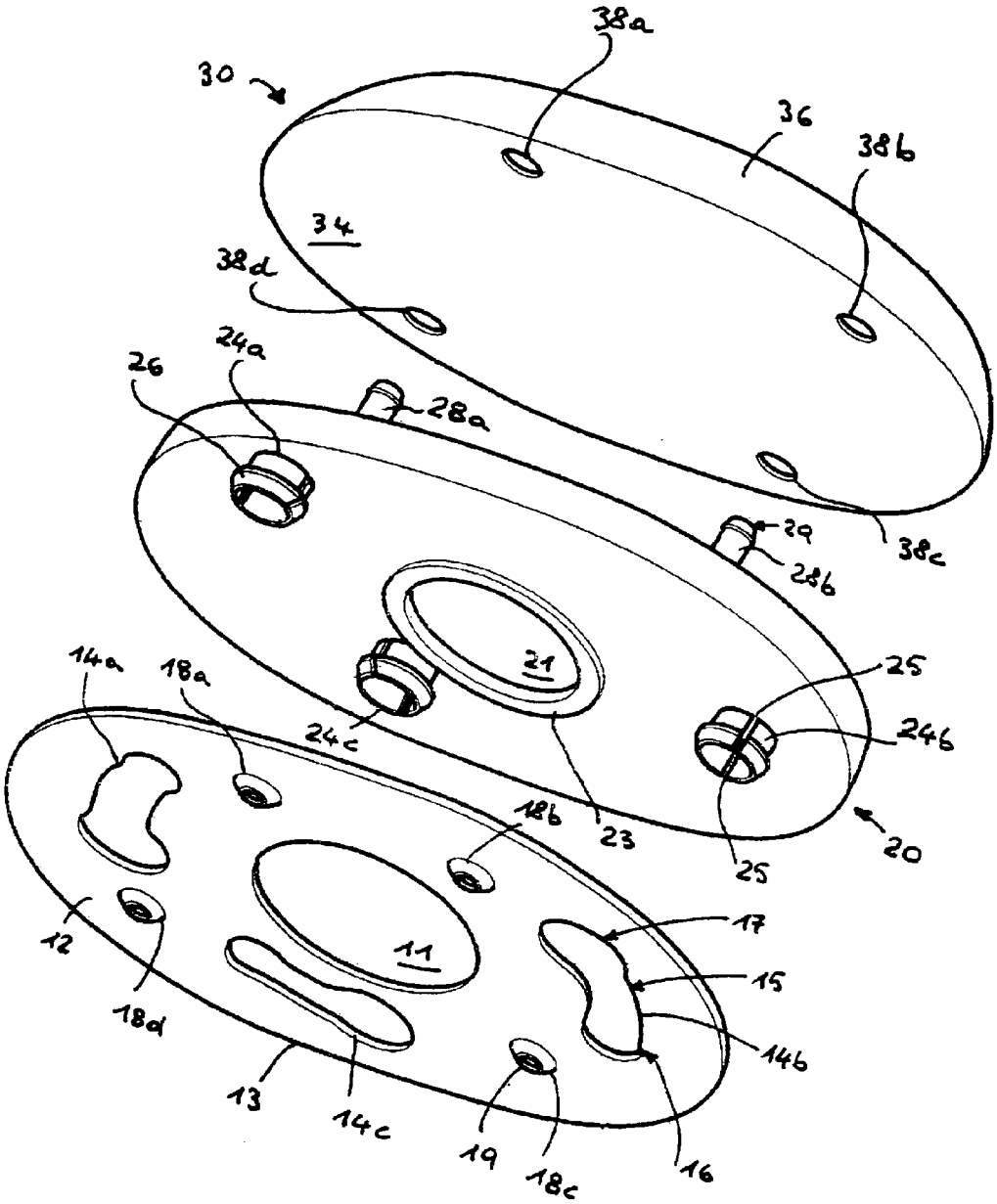
FIG. 1 is an exploded view of the knee-pad.

A knee-pad according to the invention consists essentially of a base plate 10, an intermediate element 20 and an operative element 30—see FIG. 1.

The base plate 10 of the knee-pad consists of a rigid and flat and thin disk of metal 12 with a round central opening 11, three crescent-shaped slots 14*a*, 14*b*, 14*c* which extend along a first circumference and four projections 18*a*, 18*b*, 18*c*, 18*d* which extend along a second circumference. The said projections, the bottom 19 of which is open and threaded, receive screws (not shown) by means of which the base plate 10 is fastened to the trousers worn by the person using the knee-pad.

Each of the slots 14*a* . . . 14*c*—which are not equidistant along the said first circumference—comprises a central part 15 of constant width, a first end 16 having approximately the shape of a circle with a diameter equal to the width of the said central part 15 and a second end 17 having approximately the shape of a circle with a diameter greater than the width of the same central part 15. The projections 18*a* . . .

18*d* likewise are not equidistant along the said second circumference, but the first and the second projections 18*a* and 18*b* are located in a middle position between the first slot 14*a* and the second slot 14*b,* the third projection 18*c* is in a middle position between the second slot 14*b* and the third slot 14*c,* the fourth slot 18*d* is in a middle position between the first slot 14*a* and the third slot 14i c.

The intermediate element 20 of the knee-pad also consists of a thin flat disk 22 which is made by means of injection-moulding using a rigid plastic material, for example polypropylene reinforced with calcium carbonate or glass fibre, with a central round opening 21. A first side 22*a* of the disk 22 has integrally formed on it: the projecting edge 23 of the opening 21, able to engage inside the central opening 11 of the metallic disk 12; three lugs 24*a, 24b, 24c,* having a mushroom-shaped body with a pair of longitudinal incisions 25 and a free end 26 with an undercut. The second side 22*b* of the disk 22 has, integrally formed on it, four cylindrical pins—only those of which indicated by the reference numbers 28*a* and 28*b* are visible in FIG. 1—with the free end 29 also having a small undercut.

The operative element 30 of the knee-pad consists of a body 32 in the form of a rounded swelling (i.e. much bigger than both the base plate 10 and the intermediate element 20) having a base 34 which is perfectly flat and a surface 36 which is suitably rounded. The body 32 is manufactured by means of injection-moulding using a grade of cellular plastic material having high abrasion-resistance properties, for example polyurethane. In the base 34, the body 32 of the operative element 30 comprises four cylindrical recesses 38*a, 38b, 38c, 38d.*

Assembly of the knee-pad envisages firstly insertion of the cylindrical pins such as 28*a* and 28*b* of the disk 22 inside the recesses 38*a* . . . 38*d,* the dimensions of which (diameter and depth) are correlated to those of the abovementioned pins of the body 32. In this way a connection is formed between the operative element 30 and the intermediate element 20 which is preferably rendered permanent for example by means of heat-sealing or using an adhesive compatible with the plastic materials from which these two parts of the knee-pad are made.

Alternatively, the operative element 30 may be formed by means of overinjection directly above the intermediate element 20, with a suitable choice of the associated plastic compounds. In this case both the pins 28*a* . . . 28*d* and the corresponding recesses 38*a* . . . 38*d* may be dispensed with.

In any case it will be preferable to paint the elements 20 and 30 in two strongly contrasting colours so that it is immediately obvious when the knee-pad loses its operational capacity following complete wear of its functional part, i.e. the element 30.

Figure 2:
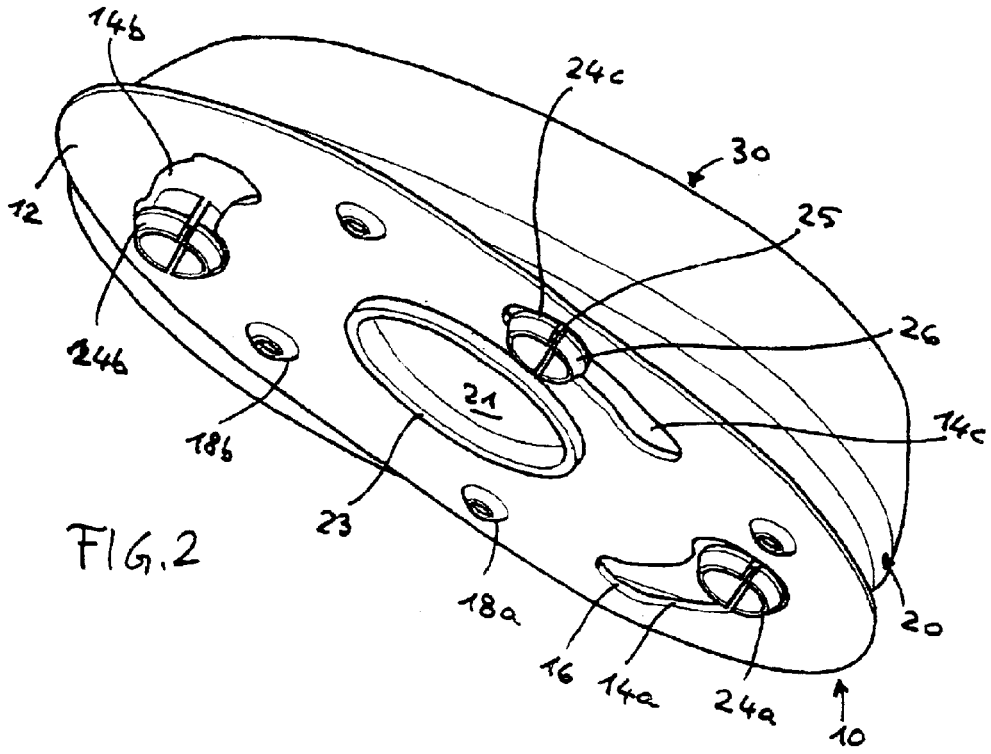
FIG. 2 shows the same knee-pad during the operation involving assembly of the parts forming it.
Figure 3:
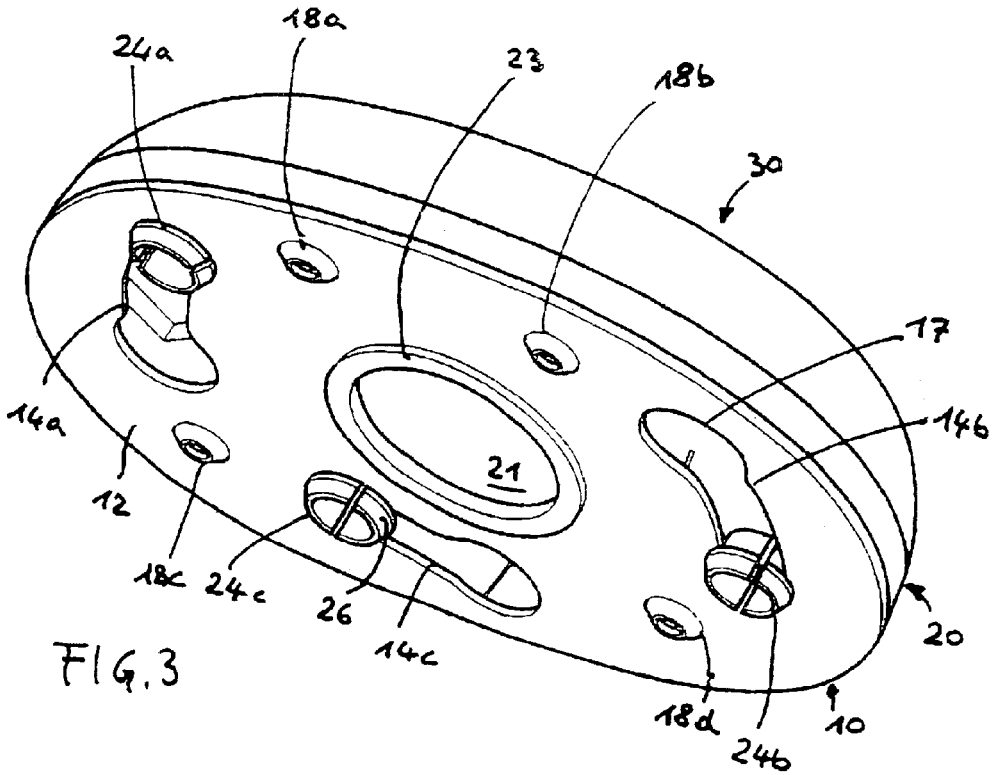
FIG. 3 shows the knee-pad at the end of said assembly operation.

The next stage of assembly envisages the insertion of the mushroom-shaped lugs 24*a* . . . 24*c* projecting from the first side 22*a* of the disk 22 into the larger-diameter ends 17 of the crescent-shaped slots 14*a* . . . 14*c* of the disk 12 as well as insertion of the edge 23 into the central opening 11, preferably after the base plate 10 has been fastened to the trousers worn by the person using the knee-pad by means of screws which engage inside the thread 19 of the projections 18*a* . . . 18*d.* Centring of the intermediate element 20—and therefore, as regards that stated above, also the operative element 30—on the base plate 10 is thus ensured. Immediately afterwards a mutual rotation, indicated by the arrow in FIG. 2, is performed, so that the mushroom-shaped lugs 24*a* . . . 24*c* slide inside the central part 15 of the slots 14*a* . . . 14*c,* without the possibility of coming out owing to the presence of the undercuts on their free ends 26, until they snap-engage inside the smaller-diameter ends 16 of the said slots, thereby completing assembly of the knee-pad (see FIG. 3). In other words, the connection of the intermediate element 20 and the operative element 30 onto the base plate 10 is of the bayonet type and its effectiveness is ensured by a suitable definition of both the constructional characteristics (presence of an undercut on the free ends 26 and the longitudinal incisions 25) and the dimensional characteristics (diameters, lengths) of the mushroom-shaped lugs 24*a* . . . 24*c* of the body 22.

The main advantage of this knee-pad is that it has a first part, namely the base plate 10, made of metallic material (for example steel) which is resistant to impacts, including those of a dynamic nature, and a second part, namely the operative element 30, which is made of a plastic material or the like resistant to abrasion and which if necessary can be separated from the first part so that it can discarded, without the need to discard at the same time the said first part as well.

Also from a constructional point of view, the knee-pad represents an improvement with respect to the state of the art, as can be deduced from the above description.

Even if the above description refers to a preferred embodiment, it is understood that the inventions is suitable to be realized in different forms and variants within the scope of the appended claims.

What is claimed is:

1. Knee-pad comprising a first part (10) able to be fastened onto a sports garment, a second part (30) able to withstand abrasion and interfacing means (24*a* . . . 24*c;* 14*a* . . . 14*c*) allowing the second part (30) to be separated from the first part (10) without the latter being detached from the garment, characterized in that said interfacing means (24*a* . . . 24*c;* 14*a* . . . 14*c*) are equally distributed on the first part (10) and on an intermediate element (20) of the knee pad fixedly connected to the second part (30) and are of the type in which the said separation takes place through a rotational movement of the second part (30) with respect to the said first part (10).

2. Knee-pad according to claim 1, characterized in that the said first part (10) is manufactured from a material which is impact-resistant, preferably a metal and in that the interfacing means, which are of the bayonet type, consist of at least two male devices (24*a* . . . 24*c*) on said intermediate element (20) and in corresponding openings (14*a* . . . 14*c*) on said first part (10) of the knee pad, the said male devices (24*a* . . . 24*d*) and openings (14*a* . . . 14*c* ) being arranged in a non-equidistant manner along a circumference.

3. Knee-pad according to claim 1, characterized in that the said intermediate element (20) is connected to the said abrasion-resistant part (30) by means of male/female fixing devices (28*a* . . . 28*d*, 38*a* . . . 38*d*) and rendered permanent, for example by means of heat-sealing or adhesive bonding.

4. Knee-pad according to claim 1, characterized in that the said abrasion-resistant part (30) is manufactured using a plastic material overinjected onto the said intermediate element (20) which is also made of a plastic material.

5. Knee-pad according to claim 1 characterized in that the said first part (10) comprises threaded zones (19) so that it can be fastened by means of screws to the garment underneath.

6. Knee-pad according to claim 1, characterized in that the said second part (30) has a different colour so as to easily realize when it has to be separated from the said first part (10).

* * * * *

UNITED STATES PATENT AND TRADEMARK OFFICE

CERTIFICATE OF CORRECTION

PATENT NO. : 6,854,129 B2
APPLICATION NO. : 10/813751
DATED : February 15, 2005
INVENTOR(S) : Gabriele Mazzarolo It is certified that error appears in the above-identified patent and that said Letters Patent is hereby corrected as shown below:

On the title of the patent, item (75) should read as follows:

(75) Inventor: Giovanni Mazzarolo, Coste di Maser (IT)

Signed and Sealed this

Tenth Day of April, 2007

JON W. DUDAS
*Director of the United States Patent and Trademark Office*